US009611131B2

(12) United States Patent
Lehman

(10) Patent No.: US 9,611,131 B2
(45) Date of Patent: Apr. 4, 2017

(54) MINI-KEG GROWLER CAP, COMPONENTS, ACCESSORIES AND DESIGNS FOR THE SAME

(71) Applicant: Deep Wood Brew Products, LLC, Rochester, MI (US)

(72) Inventor: Kevin Lehman, Rochester, MI (US)

(73) Assignee: Deep Wood Brew Products, LLC, Holly, MI (US)

( * ) Notice: Subject to any disclaimer, the term of this patent is extended or adjusted under 35 U.S.C. 154(b) by 222 days.

(21) Appl. No.: 14/465,965

(22) Filed: Aug. 22, 2014

(65) Prior Publication Data

US 2015/0274501 A1 Oct. 1, 2015

Related U.S. Application Data

(60) Provisional application No. 61/972,845, filed on Mar. 31, 2014.

(51) Int. Cl.

| | |
|---|---|
| ***B65D 83/00*** | (2006.01) |
| ***B67D 1/14*** | (2006.01) |
| ***B67D 1/04*** | (2006.01) |
| ***B67D 1/12*** | (2006.01) |
| *B67D 1/00* | (2006.01) |

(52) U.S. Cl.

CPC ..... *B67D 1/1405* (2013.01); *B67D 1/0406* (2013.01); *B67D 1/0412* (2013.01); *B67D 1/0456* (2013.01); *B67D 1/125* (2013.01); *B67D 1/0004* (2013.01)

(58) Field of Classification Search

CPC .. B67D 1/0004; B67D 1/1405; B67D 1/1477; B67D 1/04; B67D 1/0412; B67D 1/0406; B67D 1/0418; B67D 1/0456; B67D 1/125

USPC ..... 222/400.7, 397, 399, 401, 402.13, 416, 222/546, 552–554

See application file for complete search history.

(56) References Cited

U.S. PATENT DOCUMENTS

| | | | | |
|---|---|---|---|---|
| 3,596,810 A * | 8/1971 | Taubenheim | ..... | B67D 1/0832 137/212 |
| 4,180,189 A * | 12/1979 | Zurit | ..... | B67D 1/0832 137/212 |
| 4,212,414 A * | 7/1980 | Beyens | ..... | B67D 1/0851 134/166 C |
| 4,228,927 A * | 10/1980 | Beyens | ..... | B08B 9/0804 134/166 C |
| 4,728,010 A * | 3/1988 | Johnston | ..... | B67D 1/0832 137/212 |
| 5,636,657 A * | 6/1997 | Degenkolbe | ..... | B67D 1/0832 137/212 |

(Continued)

FOREIGN PATENT DOCUMENTS

| | | | | |
|---|---|---|---|---|
| DE | 280830 * | 4/1970 | ..... | B67D 1/0832 |

*Primary Examiner* — Lien Ngo

(74) *Attorney, Agent, or Firm* — BrooksGroup

(57) ABSTRACT

A number of variations may include a mini-keg growler cap mini-keg growler cap including a head having an upper disc shaped surface and an opposite lower surface connected to a cylindrical side surface having a plurality of parallel striations defined thereon and defining three threaded ports formed therein, a tapered surface extending between the cylindrical side surface and the disc shaped top surface, and threaded nipple extending from the lower surface.

11 Claims, 3 Drawing Sheets

(56) References Cited

U.S. PATENT DOCUMENTS

| | | | | |
|---|---|---|---|---|
| 5,664,702 | A * | 9/1997 | Beauchamp | B67D 1/0425 137/212 |
| 6,616,067 | B1 * | 9/2003 | Hunter | B05B 9/0822 222/209 |
| 6,955,185 | B2 * | 10/2005 | Rauworth | B67D 1/0054 137/563 |
| 9,227,827 | B1 * | 1/2016 | Scott | B67D 1/0418 |
| 9,340,403 | B2 * | 5/2016 | Daly | B67D 1/0437 |
| 2008/0011785 | A1 * | 1/2008 | Braun | B67D 7/0294 222/400.7 |

* cited by examiner

MINI-KEG GROWLER CAP, COMPONENTS, ACCESSORIES AND DESIGNS FOR THE SAME

CROSS REFERENCE TO RELATED APPLICATION

This application claims the benefit of U.S. Provisional Application No. 61/972,845 (0010.0005.001), filed Mar. 31, 2014.

TECHNICAL FIELD

The field to which the disclosure generally relates includes containers and caps for holding fluids wherein the structure includes a sealing member acting at the junction of the closure and closure support or container mouth to oppose the passage of fluid therebetween.

BACKGROUND

Storage of carbonated liquids such as beer may include the use of a glass growler. Glass growlers temporarily hold the carbonation and temperature of a liquid but leak gas which may result in lost carbonation. Glass growlers are commonly rated for low internal pressures. Glass growlers typically utilize a metal cap to seal the carbonation and liquid within the growler, which, when opened, releases carbonation and exposes the liquid to air. Mini-keg growler variations are disclosed in U.S. Ser. No. 14/075,563, filed Nov. 8, 2013, and titled Mini-Keg Growler, the disclosure of which is hereby incorporated by reference.

SUMMARY OF ILLUSTRATIVE VARIATIONS

In a number of variations, a product may include a cap for a mini-keg growler that may include a head that may include a pressure relief valve, a post for charging gas into the growler, and a dip tube.

In a number of variations, a product may include a cap for a mini-keg growler that may include a head that may include an upper disc shaped surface and an opposite lower surface connected to a cylindrical side surface having a plurality of parallel striations defined thereon. A generally tapered surface may extend between the cylindrical side surface and the disc shaped top surface. The generally tapered surface may include a head that may include a pressure relief valve, a post for charging gas into the growler, and a dip tube.

In a number of variations, a product may include a cap for a mini-keg growler which may include a head that may include an upper disc shape surface and an opposite lower surface connected to a cylindrical side surface having a plurality of parallel striations defined thereon. A generally tapered surface may extend between the cylindrical side surface and the disc shape top surface. Flat portions may be provided on the tapered surface to facilitate attachment of a pressure relief valve in one location, and a post at another location which may be used, for example, for charging a gas such as carbon dioxide into a mini-keg growler. A hose barb may be attached to the top disk shaped surface. A dip tube may be connected to the cap and extend down into the mini-keg growler and may be in fluid communication with the hose barb. A threaded nipple may extend from the lower surface of the cap. The cap may be constructed and arranged with a first threaded opening which may communicate with an opening that also communicates with the through hole and the threaded nipple. A second threaded port may be formed in the cap and may communicate with a through hole which may also communicate with the through hole and the threaded nipple. Similarly, a third threaded port may be formed in the cap and may communicate with the through hole and the threaded nipple.

It should be understood that the detailed description and enumerated variations, while disclosing optional variations, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses. The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and still are considered to be within the scope of the invention.

Figure 1:
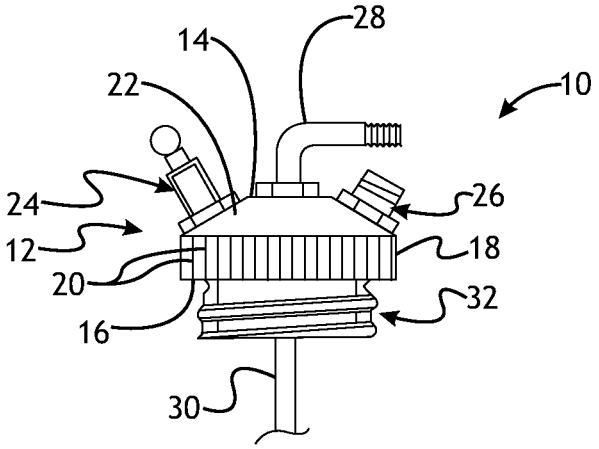
FIG. 1 depicts a side view of a cap for a mini-keg growler.

FIG. 1 illustrates a number of variations of a cap for a mini-keg growler, which may include a head 12 that may include an upper disc shape surface 14 and an opposite lower surface 16 connected to a cylindrical side surface 18 having a plurality of parallel striations 20 defined thereon. A generally tapered surface 22 may extend between the cylindrical side surface 18 and the disc shape top surface 14. Flat portions may be provided on the tapered surface 22 to facilitate attachment of a pressure relief valve 24 in one location and a post 26 at another location which may be used, for example, for charging a gas such as carbon dioxide into the mini-keg growler. In a number of variations a hose barb 28 may be attached to the top disk shaped surface 14. A dip tube 30 may be connected to the cap and may be in fluid communication with the hose barb and extend down into the mini-keg growler. A threaded nipple 32 may extend from the lower surface 16 of the cap.

Figure 2:
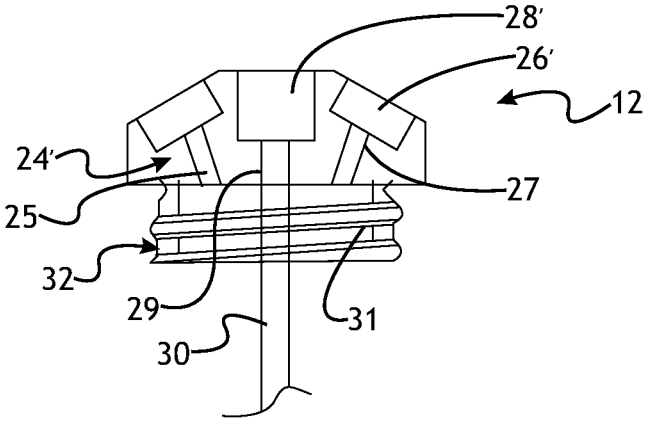
FIG. 2 depicts a cross-sectional view of the cap of a mini-keg growler.

As can be appreciated from FIG. 2, in a number of variations, the cap 12 can be constructed and arranged with a first threaded opening 24' which may communicate with an opening 25 that also communicates with the through hole 31 and the threaded nipple 32. A second threaded port 26' may be formed in the cap 12 and may communicate with a through hole 27 which also communicates with the through hole 31 and the threaded nipple 32. Similarly, a third threaded port 28' may be formed in the cap 12 and may communicate with a through hole 29 that communicates with the through hole 31 and the threaded nipple 32.

Figure 3:
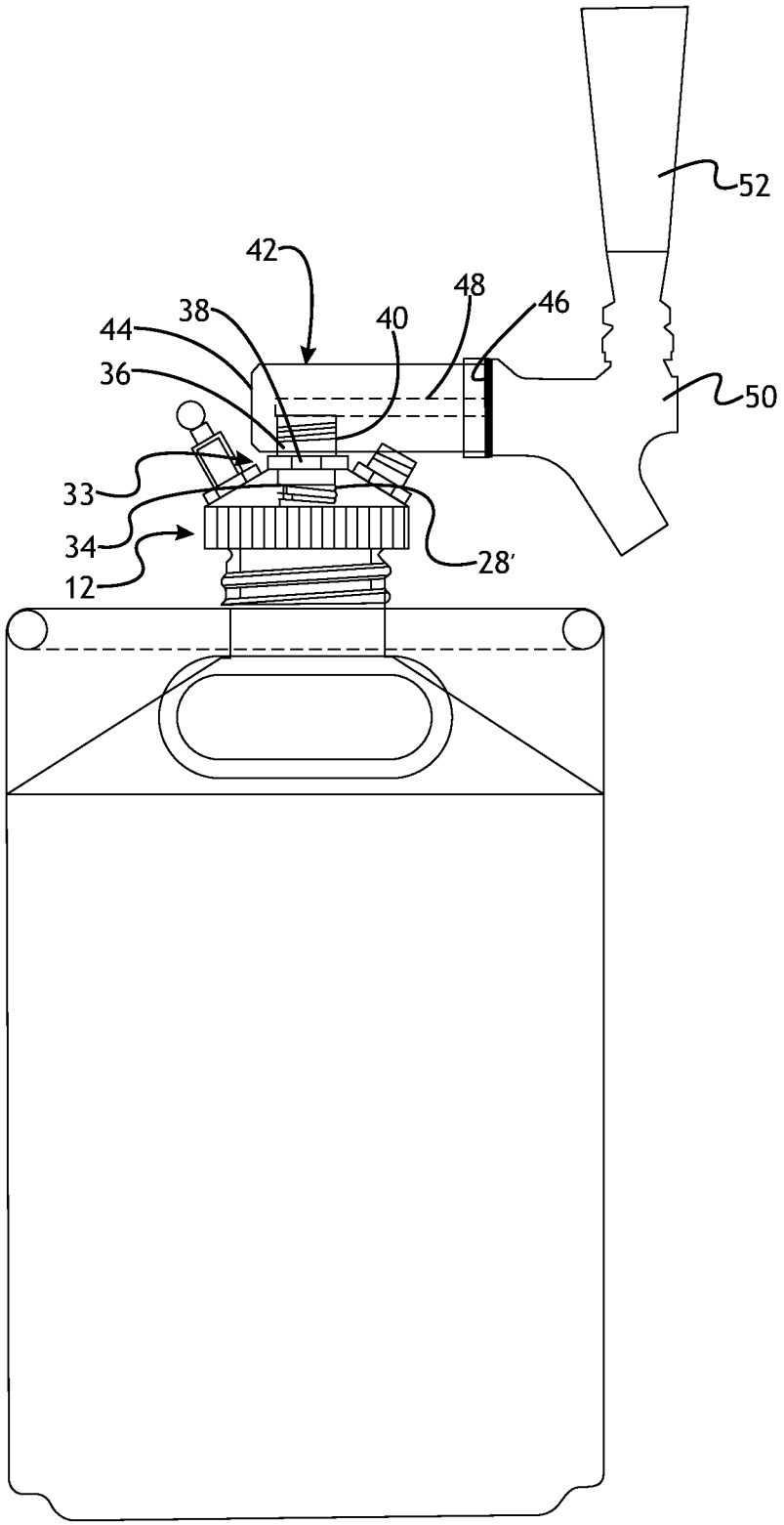
FIG. 3 depicts a side view of a cap of a mini-keg growler.
Figure 4:
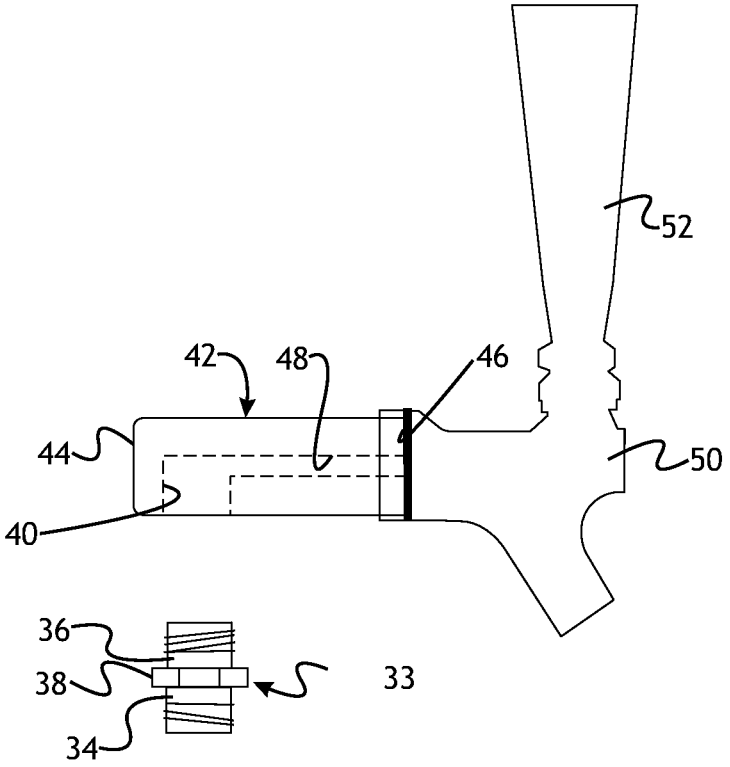
FIG. 4 depicts a cross-sectional view of a tap handle connector for a cap of a mini-keg growler.

According to FIGS. 3 & 4, in a number of other variations, a connector 33 having a first male threaded nipple 34 and an opposite second male threaded nipple 36 spaced apart by a nut portion may be threaded into the third threaded port 28' of the cap 12. The second male threaded nipple 26 may be threaded into a threaded port opening 40 in a faucet shank 42. The threaded port opening 40 in the faucet shank 42 may be positioned along the longitudinal edge of the faucet shank 42. The faucet shank 42 may include a closed first end 44 and an opposite second end 46. A through hole 48 may extend from the threaded port opening 40 to the first end 46 of the faucet shank 42. A beer faucet 50 may be attached to the second end 46 of the faucet shank 42. A tap handle 52 may be attached to the beer faucet 50.

Figure 5:
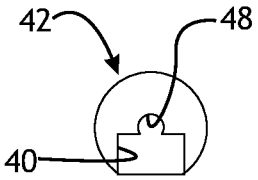
FIG. 5 depicts a cross-section of a faucet shank.

FIG. 5 illustrates a cross-section of the faucet shank 42 showing the fluid communication of the through hole 48 with the threaded port opening 40.

The cap 12 may be made of stainless steel, aluminum, metal, metal alloy, or other metallic material or other material suitable for use in high pressure vessels. According to a number of variations, the cap may be formed or machined from a cast metal. The cap may be constructed and arranged to sealingly mate with the growler such that a cavity within the growler is sealingly closed off from the exterior of the container.

The pressure relief valve 24 may be removably attached to the cap 12. The cap 12 may define a through-hole into which the pressure relief valve 24 may be sealingly inserted. The pressure release valve 24 may be constructed and arranged to allow pressurized gas to exit the growler at the discretion of a user, while preventing atmospheric fluids from entering the growler.

The post 26 may be removably attached to the cap 12. The cap 12 may define a through-hole into which the post 26 may be sealingly inserted. The post 26 may be constructed and arranged to allow pressurized gas or fluid such as carbon dioxide to flow the through the post, through the cap, and into the growler such that the contents of the growler become pressurized. The post 26 may be a ball-lock gas post or a pin-lock gas post as are commonly used in the beer brewing profession.

The dip tube 28 may be removably attached to the cap 12. The cap 12 may define a through-hole into which the dip tube 28 may be sealingly inserted. The dip tube 28 may be of any dimension as desired, and may have a portion extending out from the cap and having a barbed end such that tubing may be affixed to the dip tube 28. The dip tube 28 may also extend from the bottom of the cap into a growler such that fluid may flow from the growler, through the dip tube 28, and out.

The faucet shank 42 may be removably attached to the cap 12. The cap 12 may define a through-hole into which the faucet shank 42 may be sealingly inserted. A connector 33 having a first male threaded nipple 34 and an opposite second male threaded nipple 36 spaced apart by a nut portion may be sealingly inserted into the cap 12. The second male threaded nipple 26 may be threaded into a threaded port opening 40 in a faucet shank 42. The threaded port opening 40 in the faucet shank 42 may be positioned along the longitudinal edge of the faucet shank 42. The faucet shank 42 may include a closed first end 44 and an opposite second end 46. A through hole 48 may extend from the threaded port opening 40 to the first end 46 of the faucet shank 42. A beer faucet 50 may be attached to the second end 46 of the faucet shank 42. A tap handle 52 may be attached to the beer faucet 50.

In use and in practice, a mini-keg growler may be filled with a fluid such as beer. The cap may be sealingly threaded onto the growler. The gas post may be used to charge the growler with a pressurized fluid such as carbon dioxide, thereby maintaining the carbonation of the beer within the growler. The pressure relief valve may be used to relieve the pressure of the carbon dioxide within the growler. The dip tube may be in communication with a hose barb or connector, faucet shank, and beer faucet assembly such that a user may allow pressurized beer to flow out of the growler.

According to Variation 1, a product may include a mini-keg growler cap that may include a head that may have an upper disc shape surface and an opposite lower surface connected to a cylindrical side surface that may have a plurality of parallel striations defined thereon and that may define three threaded ports formed therein, a tapered surface extending between the cylindrical side surface and the disc shape top surface, and threaded nipple that may extend from the lower surface.

Variation 2 may include a product as set forth in variation 1 wherein the three threaded ports may include a first threaded port constructed and arranged to sealingly receive a pressure relief valve.

Variation 3 may include a product as set forth in variation 1 or 2 wherein the three threaded ports may include a second threaded port constructed and arranged to sealingly receive a dip tube.

Variation 4 may include a product as set forth in any of variations 1 through 3 wherein the three threaded ports may include a third threaded port constructed and arranged to sealingly receive a gas post.

Variation 5 may include a product as set forth in variation 4 wherein the gas post may be a ball-lock type gas post.

Variation 6 may include a product as set forth in variation 4 wherein the gas post may be a pin-lock type gas post.

Variation 7 may include a product as set forth in any of variations 1 through 6 wherein the three threaded ports may include a second threaded port constructed and arranged to sealingly receive a connector that may have a first male threaded nipple and an opposite second male threaded nipple spaced apart by a nut portion and defining a channel there through.

Variation 8 may include a product as set forth in variation 7 that may further include a faucet shank constructed and arranged to be threaded to the connector and that may include a closed first end, an opposite second end, and a through hole extending between the two such that fluid may be capable of flowing from the second threaded port, through the channel within the connector and into the through hole of the faucet shank.

Variation 9 may include a product as set forth in any of variations 1 through 8 that may further include a beer faucet connected to the second end of the faucet shank and a tap handled attached to the beer faucet and where the first end of the faucet shank may be connected to the connector.

According to Variation 10, a product that may include a mini-keg growler cap that may include a head that may include an upper disc shape surface; an opposite lower surface connected to a cylindrical side surface that may have a plurality of parallel striations defined thereon; a tapered surface extending between the cylindrical side surface and the disc shape top surface and that may have a plurality of flat portions on the tapered surface; a plurality of through-holes that may be defined by the cap on the plurality of flat portions wherein the plurality of through-holes may facilitate attachment of a pressure relief valve in a first through-hole, a gas post in a second through-hole, and a fluid outlet in a third through-hole; and a threaded nipple extending from the lower surface constructed and arranged to sealingly mate with a growler.

Variation 11 may include a product as set forth in variation 10 wherein the first through-hole may include a first threaded port constructed and arranged to sealingly receive a pressure relief valve.

Variation 12 may include a product as set forth in any of variations 10 through 11 wherein the second through-hole may include a second threaded port constructed and arranged to sealingly receive a dip tube.

Variation 13 may include a product as set forth in any of variations 10 through 12 wherein the third through-hole may include a third threaded port constructed and arranged to sealingly receive a gas post.

Variation 14 may include a product as set forth in variation 13 wherein the gas post may be a ball-lock type gas post.

Variation 15 may include a product as set forth in variation 13 wherein the gas post may be a pin-lock type gas post.

Variation 16 may include a product as set forth in any of variations 1 through 15 wherein the second through-hole may include a second threaded port constructed and arranged to sealingly receive a connector that may have a first male threaded nipple and an opposite second male threaded nipple spaced apart by a nut portion and defining a channel there through.

Variation 17 may include a product as set forth in variation 16 that may further include a faucet shank constructed and arranged to be threaded to the connector and that may include a closed first end, an opposite second end, and a through hole extending between the two such that fluid may be capable of flowing from the second threaded port, through the channel within the connector and into the through hole of the faucet shank.

Variation 18 may include a product as set forth in any of variations 1 through 17 and may further include a beer faucet connected to the second end of the faucet shank and a tap handled attached to the beer faucet and wherein the first end of the faucet shank may be connected to the connector.

Variation 19 may include a product as set forth in any of variations 1 through 18 that may further include a mini-keg growler.

According to Variation 20, a product may include a mini-keg growler; a mini-keg growler cap that may include a head that may include an upper disc shape surface; an opposite lower surface connected to a cylindrical side surface that may have a plurality of parallel striations defined thereon; a tapered surface extending between the cylindrical side surface and the disc shape top surface and that may have a plurality of flat portions on the tapered surface; a plurality of through-holes defined by the cap on the plurality of flat portions wherein the plurality of through-holes may include a first through-hole that may include a first threaded port constructed and arranged to sealingly receive a pressure relief valve, a second through-hole that may include a second threaded port constructed and arranged to sealingly receive a dip tube, and a third through-hole that may include a third threaded port constructed and arranged to sealingly receive a gas post; a pressure relief valve disposed within the first through-hole; a dip tube may be disposed within the second through-hole; a gas post may be disposed within the third through-hole wherein the gas post is a ball-lock type gas post or a pin-lock type gas post; and a threaded nipple extending from the lower surface constructed and arranged to sealingly mate with a growler.

The above description of variations of the invention is merely demonstrative in nature and, thus, variations thereof are not to be regarded as a departure from the spirit and scope of the inventions disclosed within this document.

What is claimed is:

1. A product comprising:

a mini-keg growler cap comprising a head comprising;

an upper disc shaped surface;

an opposite lower surface connected to a cylindrical side surface having a plurality of parallel striations defined thereon;

a tapered surface extending between the cylindrical side surface and the disc shaped top surface and having a plurality of flat portions on the tapered surface;

a plurality of through-holes defined by the cap on the plurality of flat portions wherein the plurality of through-holes facilitate attachment of a pressure relief valve in a first through-hole, a gas post in a second through-hole, and a fluid outlet in a third through-hole; and a threaded nipple extending from the lower surface constructed and arranged to sealingly mate with a growler.

2. A product as set forth in claim 1, wherein the first through-hole comprises a first threaded port constructed and arranged to sealingly receive a pressure relief valve.

3. A product as set forth in claim 1, wherein the second through-hole comprises a second threaded port constructed and arranged to sealingly receive a dip tube.

4. A product as set forth in claim 1, wherein the third through-hole comprises a third threaded port constructed and arranged to sealingly receive a gas post.

5. A product as set forth in claim 4, wherein the gas post is a ball-lock type gas post.

6. A product as set forth in claim 4, wherein the gas post is a pin-lock type gas post.

7. A product as set forth in claim 1, wherein the second through-hole comprises a second threaded port constructed and arranged to sealingly receive a connector having a first male threaded nipple and an opposite second male threaded nipple spaced apart by a nut portion and defining a channel therethrough.

8. A product as set forth in claim 7, further comprising a faucet shank constructed and arranged to threaded to the connector and comprising a closed first end, an opposite second end, and a through hole extending between the two such that fluid is capable of flowing from the second threaded port, through the channel within the connector and into the through hole of the faucet shank.

9. A product as set forth in claim 8, further comprising:

a beer faucet connected to the second end of the faucet shank; and a tap handled attached to the beer faucet and wherein the first end of the faucet shank is connected to the connector.

10. A product as set forth in claim 1, further comprising a mini-keg growler.

11. A product comprising:

a mini-keg growler;

a mini-keg growler cap comprising a head comprising;

an upper disc shaped surface;

an opposite lower surface connected to a cylindrical side surface having a plurality of parallel striations defined thereon;

a tapered surface extending between the cylindrical side surface and the disc shaped top surface and having a plurality of flat portions on the tapered surface;

a plurality of through-holes defined by the cap on the plurality of flat portions wherein the plurality of through-holes comprises a first through-hole comprising a first threaded port constructed and arranged to sealingly receive a pressure relief valve, a second through-hole comprising a second threaded port constructed and arranged to sealingly receive a dip tube, and a third through-hole comprising a third threaded port constructed and arranged to sealingly receive a gas post;

a pressure relief valve disposed within the first through-hole;

a dip tube disposed within the second through-hole;

a gas post disposed within the third through-hole wherein the gas post is a ball-lock type gas post or a pin-lock type gas post; and a threaded nipple extending from the lower surface constructed and arranged to sealingly mate with a growler.

* * * * *